US006553919B1

(12) United States Patent
Nevin

(10) Patent No.: US 6,553,919 B1
(45) **Date of Patent: *Apr. 29, 2003**

(54) COMPUTER DESK WITH CONCEALABLE DISPLAY

(76) Inventor: Donald Nevin, 3 Clearmeadow Ct., Woodbury, NY (US) 11797

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/348,615

(22) Filed: Jul. 6, 1999

(51) Int. Cl.[7] ..... A47B 23/00
(52) U.S. Cl. ..... 108/50.01; 108/25
(58) Field of Search ..... 312/7.2, 194, 196, 312/223.3, 232; 108/25, 26, 50.01, 50.02, 104; 248/918, 919, 920, 921, 922, 923, 924; 348/836

(56) References Cited

U.S. PATENT DOCUMENTS

| | | | | | |
|---|---|---|---|---|---|
| 4,654,756 | A | | 3/1987 | Wilson et al. | |
| 4,669,789 | A | | 6/1987 | Pemberton | |
| 4,695,104 | A | * | 9/1987 | Lederman | 312/223.2 |
| 5,651,594 | A | | 7/1997 | Lechman | |
| 5,655,823 | A | | 8/1997 | Schairbaum | |
| 5,699,225 | A | * | 12/1997 | Yavitz et al. | 108/50.01 |
| 5,758,934 | A | | 6/1998 | Flutka et al. | |
| 5,763,985 | A | | 6/1998 | Asinovsky | |
| 5,797,666 | A | | 8/1998 | Park | |
| 6,056,248 | A | * | 5/2000 | Ma | 248/920 |

FOREIGN PATENT DOCUMENTS

| | | | | |
|---|---|---|---|---|
| GB | 833353 | * | 4/1960 | 312/7.2 |
| JP | 4-63739 | * | 2/1992 | 348/836 |

* cited by examiner

*Primary Examiner*—Jose V. Chen
*Assistant Examiner*—Jerry A. Anderson
(74) *Attorney, Agent, or Firm*—Robert L. Epstein; Harold James; James & Franklin, LLP

(57) ABSTRACT

The work surface has a recess into which a solid state display is received. The display is mounted for movement between a storage position, where the rear surface is co-planar with, and forms a part of, the work surface and a viewing position wherein the display screen is visible. The angle of the display relative to the work surface is adjustable about a horizontal axis for viewing comfort. In one embodiment, the recess is located in a circular section of the work surface which is rotatable relative to the remainder of the surface so as to permit adjustment of the position of the display about a vertical axis, as well.

12 Claims, 4 Drawing Sheets

COMPUTER DESK WITH CONCEALABLE DISPLAY

The present invention relates to furniture designed for use with computer equipment and more particularly to a desk or table with a built-in, concealable, position adjustable solid state display which, in the storage position, forms a portion of the work surface.

Solid state computer monitor displays are replacing cathode ray tubes and as the display of choice because of the reduced weight, size and cost of the solid state displays. Such displays are often provided in the form of a flat screen in a rectangular plastic or metal enclosure where the screen forms a portion of the front surface and the rear surface of the display is substantially planar.

A wide variety of furniture, in the form of desks, tables or the like, are designed specifically for use with computer equipment. Some have provision for CRT displays which are positioned in or on the work surface, in a fixed fashion. However, the size and location of the CRT display makes the work surface unusable for other functions. It is also known to build the CRT screen below a transparent glass section of the work surface. However, having a section of the work surface made of glass is not desirable because same is subject to scratching and breakage. Moreover, the screen is situated at a position which makes it uncomfortable to view, especially after an extended period.

My invention provides a desk or table with a built-in, concealable, solid state display, where the work surface is completely useable when the display is in the storage position. This is achieved by providing the work surface with a recess within which the solid state display is stored when not in use. The display is mounted so that it can be moved to an appropriate viewing position, relative to the work surface, when required. The desk may also include compartments to store the keyboard and other computer components, which can be accessed as needed.

When not in use, the display is stored in the recess. In the storage position, the rear surface of the display is co-planar with and forms a part of the work surface, so that the desk or table appears to be, and can be used as, a conventional desk or table. However, when the computer is in use, and the display is in the viewing position, the desk or table becomes a work station specially designed for a computer.

It is, therefore, a prime object of the present invention to provide an article of furniture with a concealable solid state display.

It is still another object of the present invention to provide an article of furniture with a concealable solid state display in which the rear surface of the display is co-planar with and forms a part of the work surface, when in the storage position.

It is another object of the present invention to provide an article of furniture with a concealable solid state display wherein the display, in the viewing position, is position adjustable about a horizontal axis and about a vertical axis.

In accordance with the present invention, an article of furniture is provided comprising a substantially planar work surface having a recess. The article is designed to incorporate a solid state computer display with a viewing screen. The display includes a front surface comprising the screen and a substantially planar rear surface. Means are provided for mounting the display for movement relative to the work surface between a storage position, wherein the display is within the recess and the rear surface is substantially co-planar with the work surface, and a viewing position, wherein the screen is visible.

The mounting means includes means for adjusting the position of the display about a horizontal axis, so as to permit selection of the angle of the screen relative to the work surface to enhance comfort. A compartment is provided in the furniture which is adapted to receive other computer components. Cable means connect the other computer components and the display. A computer keyboard is also provided, as are means for connecting keyboard and the other computer components.

The mounting means includes a bracket. The bracket has a first portion pivotally connected to the article and a second portion pivotally connected to the display.

The recess in the work surface is defined, in part, by a surface. The position adjusting means includes first and second spaced grooves in the recess surface. The grooves are adapted to receive the corner of the display.

The work surface may include a circular section within which the recess is situated. Means are provided for mounting the circular section for movement about a vertical axis such that it rotates relative to the remainder of the work surface.

To these and such other objects which may hereinafter appear, the present invention relates to an article of furniture with a concealable solid state computer display, as set forth in detail in the following specification and recited in the annexed claims, taken together with the accompanying drawings, in which like numerals refer to like parts and in which:

Figure 1:
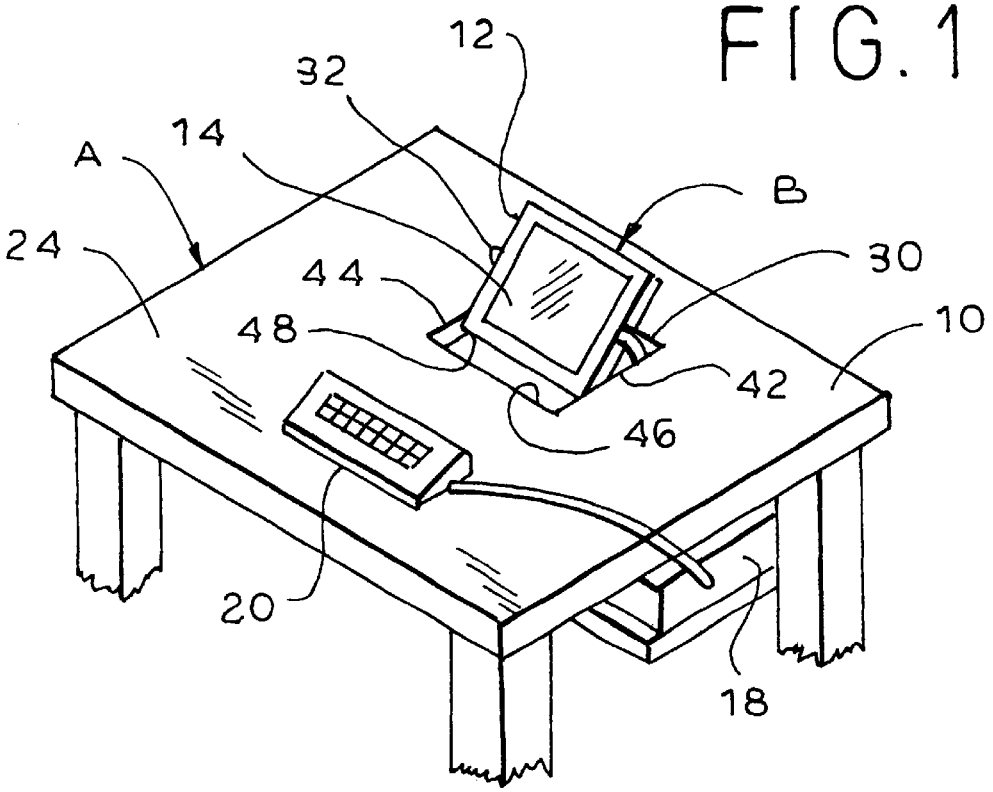
FIG. 1 is an isometric view of the first preferred embodiment of my invention shown with the display in the viewing position.

As seen in the drawings, my invention includes an article of furniture, such as a desk or table, generally designated A, with a substantially planar horizontal work surface 10. Article A is designed for use with a computer system which includes a solid state display situated in a substantially rectangular enclosure, generally designated B. Display B has a front surface 12 which includes a screen 14 and a substantially planar rear surface 16. Also part of the system is a CPU component 18 and a mobile keyboard 20.

Figure 2:
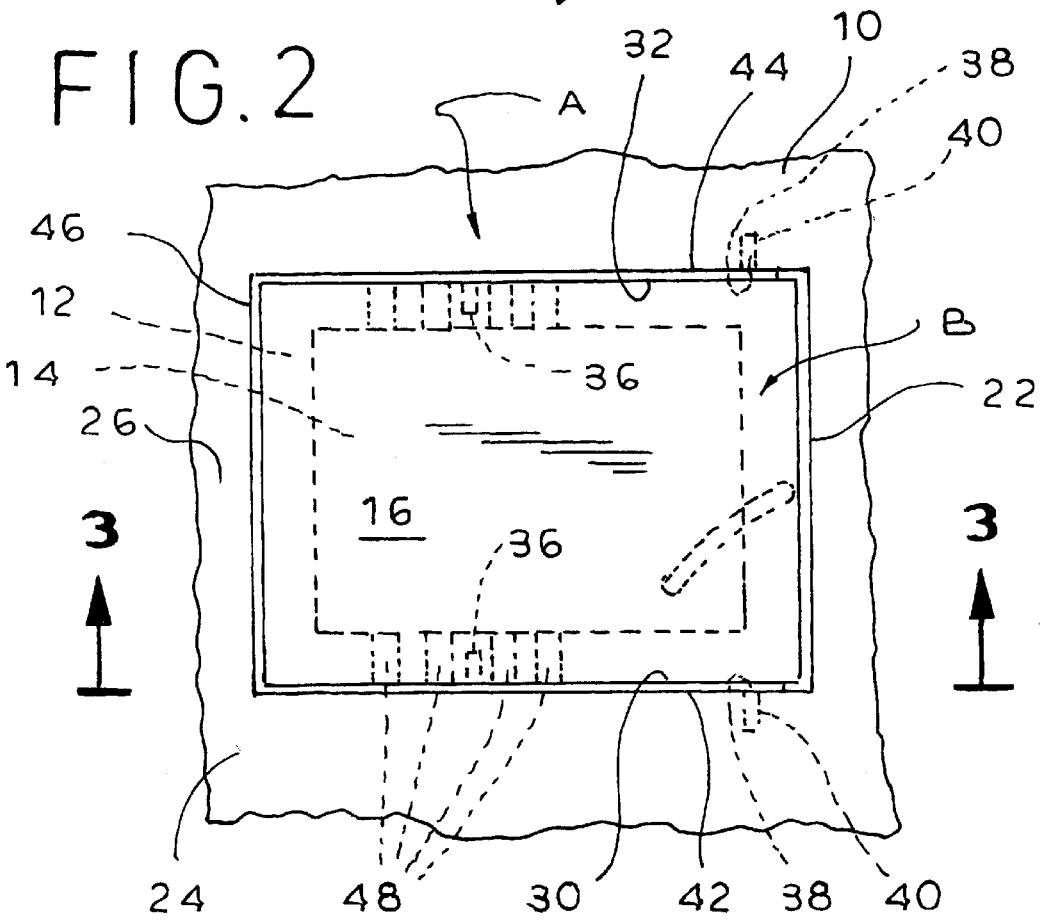
FIG. 2 is a top elevational view of the first preferred embodiment of my invention.
Figure 3:
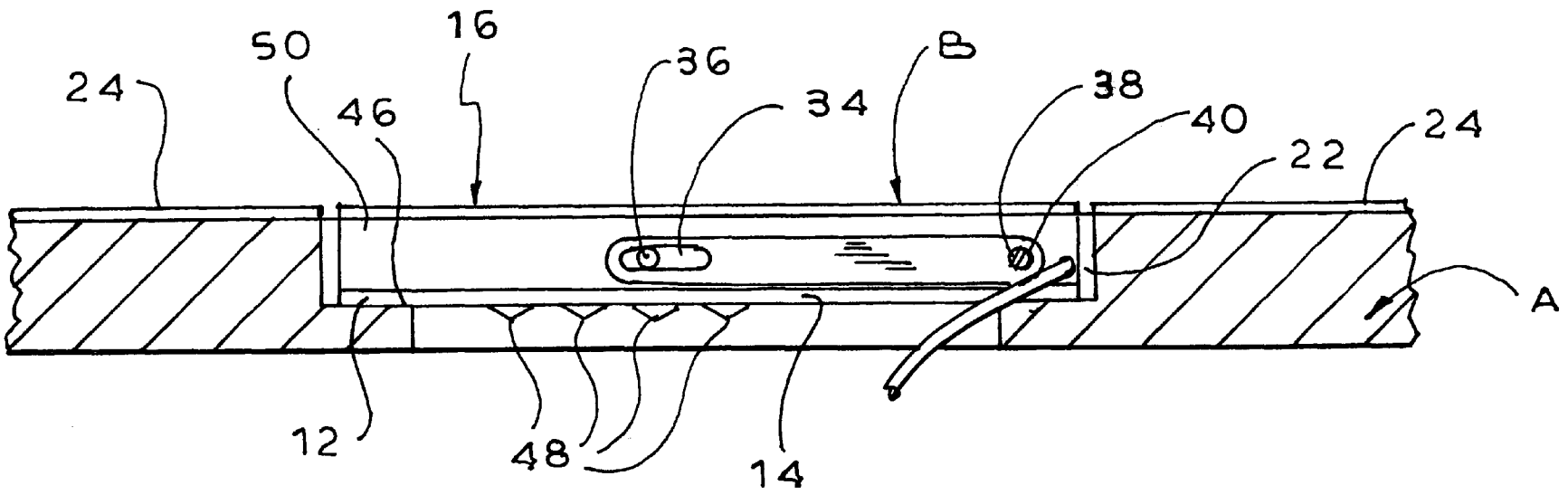
FIG. 3 is a cross-sectional view taken along line 3—3, of FIG. 1, showing the display in the storage position.
Figure 4:
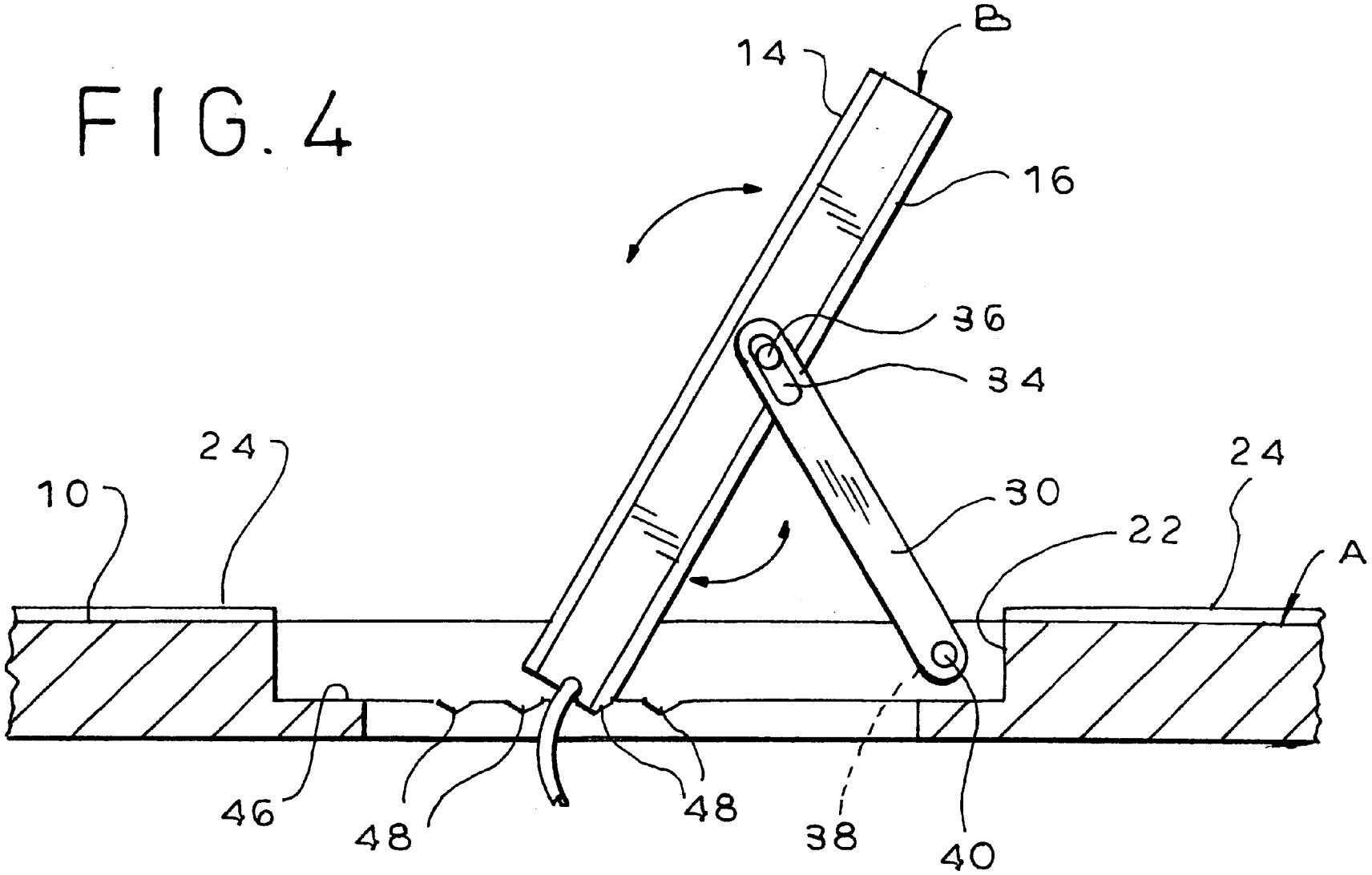
FIG. 4 is a view similar to FIG. 3, showing the display in the viewing position.
Figure 5:
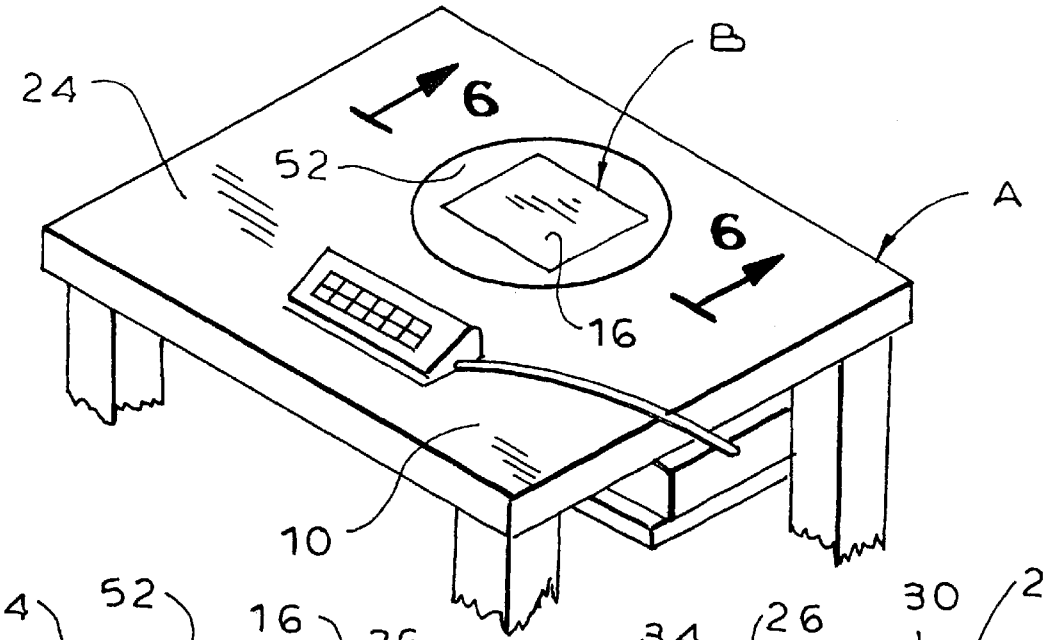
FIG. 5 is an isometric view of a second preferred embodiment of my invention showing the display in the storage position.
Figure 6:
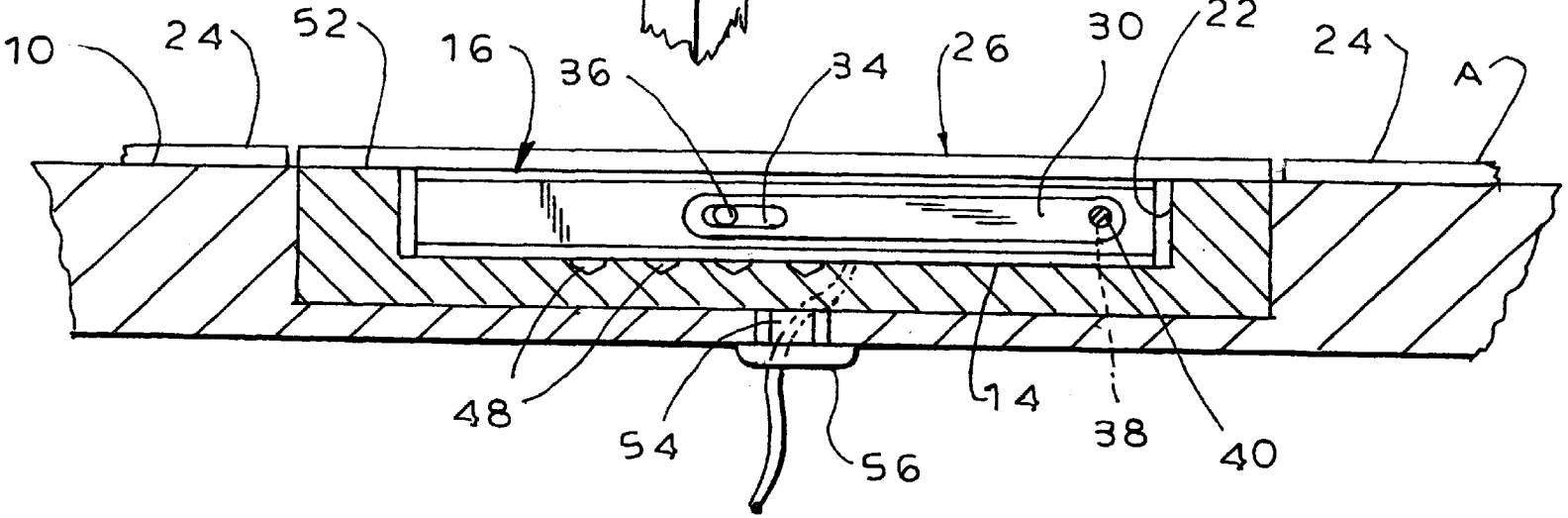
FIG. 6 is a cross-sectional view taken along line 6—6 of FIG. 5.

As seen in FIG. 2, surface 10 has a generally rectangular recess 22, approximately the size of display B. When not in use, display B is stored within recess 22, with the rear surface 16 of the display substantially co-planar with work surface 10, such that it forms a portion thereof. If the work surface includes a veneer as seen in FIG. 3, such as a top layer 24, a similar veneer layer 26 may be provided over rear surface 16 such that the work surface 10 appears uniform when the display is in the storage position.

Display B is mounted between a pair of spaced, metal or plastic brackets 30, 32. Each bracket 30, 32 is provided with a slot 34 adapted to receive one of two colinear pins 36 extending outwardly in opposite directions from the central portions of the side walls of display B so as to permit display B to rotate about a horizontal axis defined by pins 36. This axis is spaced from but substantially parallel to the work surface.

The lower portion of each bracket 30, 32 is provided with a second opening 38 which is adapted to receive one of two colinear pins 40 extending inwardly from opposing side walls 42, 44 which, in part, define recess 22. Brackets 30, 32 are rotatable about a horizontal axis defined by pins 40.

The floor or bottom surface 46 of recess 22 is provided with a plurality of spaced grooves 48 adapted to receive the lower rear corner 50 of display B. The angle of the viewing position of display B can be adjusted about a horizontal axis by rotating the display relative to brackets 30, 32 until the corner 50 of display B is situated in a selected one of grooves 48.

Alternately, the viewing angle can be made continuously adjustable about a horizonal axis by utilizing conventional friction bearings at the location where the pins are received in brackets 30, 32. In this way, the display will remain in any angular position relative to a horizontal axis where it is placed.

If it is also desired to have the display position adjustable about a vertical axis, the second preferred embodiment of my invention can be utilized. In this embodiment, all aspects of the invention are as described except that recess 10 is formed in a circular section 52 of work surface 10. Section 52 is mounted for rotation about a vertical pin 54, on a bearing collar 56, such that it rotates about a vertical axis relative to the remainder of the work surface. In this embodiment, the position of the display can be adjusted both horizontally and vertically.

It should now be appreciated that the present invention relates to an article of furniture, such as a desk or table, with a work surface. A solid state computer display is stored in a recess in the work surface such that its rear surface is co-planar with, and forms a part of, the work surface. The display is mounted for movement to a viewing position which is adjustable about a horizontal axis. In a second embodiment, the enclosure is also adjustable about a vertical axis.

Although only a limited number of preferred embodiments of the present invention have been disclosed for purposes of illustration, it is obvious that many variations and modifications could be made thereto. It is intended to cover all of these variations and modifications which fall within the scope of the present invention, as defined by the following claims.

I claim:

1. An article of furniture comprising a base, a work surface fixedly mounted to said base, having a recess with given length and width dimensions, a solid state computer display with a viewing screen, said display having a front surface comprising the screen and a substantially planar rear surface having substantially said given length and width dimensions and means for mounting said display for movement relative to said work surface between a storage position, wherein said display is within said recess and said rear display surface is substantially co-planar with said work surface, and a viewing position, wherein said display is inclined relative to and situated at least partially above said work surface.

2. The article of claim 1 wherein said mounting means comprises means for adjusting the position of said display relative to said work surface.

3. The article of claim 2 wherein said position adjusting means adjusts the position of said display about a substantially horizontal axis.

4. The article of claim 1 further comprising a computer component, a compartment adapted to receive said computer component and means for connecting said computer component and said display.

5. The article of claim 1 further comprising a computer keyboard and means for connecting said keyboard and said computer component.

6. The article of claim 1 wherein said mounting means comprises a bracket, said bracket having a means for pivotally connecting said bracket to said article and means for pivotally connecting said bracket to said display.

7. The article of claim 2 wherein said display comprises a corner and wherein said recess is-defined, in part, by a surface and wherein said position adjusting means composes first and second spaced grooves in said recess surface, said grooves being adapted to receive the corner of said display.

8. The article of claim 2 wherein said position adjusting means adjusts the position of said display about a substantially vertical axis.

9. The article of claim 1 wherein said work surface comprises a circular section within which said recess is situated and means for mounting said circular section for rotation relative to the remainder of said work surface.

10. The article of claim 9 wherein said circular section rotates about an axis substantially perpendicular to said work surface.

11. The apparatus of claim 1 wherein said position adjusting means adjusts the position of said display about a substantially vertical axis.

12. An article of furniture comprising a substantially planar work surface having a recess and a solid state computer display with a viewing screen, said display having a front surface comprising the screen and a substantially planar rear surface, and means for mounting said display for movement relative to said work surface between a storage position, wherein said display is within said recess and said rear display surface is substantially coplanar with said work surface, and a viewing position, wherein said screen is visible, said mounting means comprising means for adjusting the position of said display relative to said work surface, said display comprising a corner, said recess being defined, in part, by a surface and said position adjusting means comprising first and second spaced grooves in said recess surface, said grooves being adapted to receive the corner of said display.

* * * * *